US006726575B1

(12) United States Patent
Thorp et al.

(10) Patent No.: US 6,726,575 B1
(45) Date of Patent: Apr. 27, 2004

(54) GOLF CUP BELL

(76) Inventors: James H. Thorp, 41 Maplewood Ave., Westerly, RI (US) 02891; Newell A. Stamm, 102 Halleran Dr., Newington, CT (US) 06111

( * ) Notice: Subject to any disclaimer, the term of this patent is extended or adjusted under 35 U.S.C. 154(b) by 0 days.

(21) Appl. No.: 10/338,213

(22) Filed: Jan. 8, 2003

(51) Int. Cl.[7] ..... A63B 57/00
(52) U.S. Cl. ..... 473/176; 473/190
(58) Field of Search ..... 473/153, 175, 473/176, 190, 192, 180; 84/406, 407

(56) References Cited

U.S. PATENT DOCUMENTS

| | | | | |
|---|---|---|---|---|
| 352,794 A | * | 11/1886 | Widdows | 116/150 |
| 2,737,392 A | | 3/1956 | Stokes | |
| 3,627,327 A | | 12/1971 | White | |
| 4,120,496 A | | 10/1978 | Niina | |
| 4,270,751 A | | 6/1981 | Lowy | |
| 5,029,867 A | | 7/1991 | Johnson | |
| 5,242,169 A | * | 9/1993 | Laabs et al. | 473/184 |
| 5,306,013 A | | 4/1994 | Germinario | |
| 5,351,950 A | | 10/1994 | Frankum | |
| 5,584,768 A | * | 12/1996 | Lee | 473/190 |
| 5,685,780 A | * | 11/1997 | Desjardins | 473/178 |
| 5,735,751 A | | 4/1998 | Pacheco | |

* cited by examiner

*Primary Examiner*—Mark S. Graham
(74) *Attorney, Agent, or Firm*—McCormick, Paulding & Huber LLP

(57) ABSTRACT

A golf cup bell is provided including a bell and a bracket coupled to the bell for supporting the bell interior a golf cup such that a golf ball entering the golf cup strikes the bell causing the bell to move relative to the bracket producing an audible ring for indicating the golf ball's entry into the golf cup. The golf cup bell is designed to be mountable in a standard golf cup. In one embodiment the bell defines a central opening for receiving a flag stick therethrough. Also disclosed is a golf cup including a cylindrical housing and a golf cup bell as described above.

19 Claims, 2 Drawing Sheets

GOLF CUP BELL

FIELD OF THE INVENTION

The present invention generally relates to golf cup bells, and in particular, to a golf cup bell positionable in a golf cup for providing an audible ring upon entry of a golf ball into the golf cup.

BACKGROUND OF THE INVENTION

Most golf cups are typically made of soft metal or plastic such that when a golf ball enters such a golf cup, the sound produced may be described as a kerplunk, or a plop sound, rather than the ping or ringing sound produced by more traditional metallic golf cups. For many golfers, the sound a golf ball makes when entering the golf cup is an indicator of the successful completion of the hole and thus a significant part of the game.

Accordingly, prior art devices have been designed to reproduce the sound of the metallic ping or ringing of traditional metallic golf cups. One such golf cup is described in U.S. Pat. No. 4,120,496 issued Oct. 17, 1978 to Yozo Niina. The Niina golf cup includes a circuit box having an energy source and an electronic sound producing device disposed interior the circuit box. A contact plate mounted on a top surface of the circuit box activates the sound producing device when a golf ball lands on the contact plate. The circuit box is attached interior the golf cup.

Another sound producing golf cup is described in U.S. Pat. No. 5,351,930 issued Oct. 4, 1994 to John Frankum. The Frankum golf cup includes a vertical tube having top and bottom ends and a non-metallic carriage having a metallic portion suspended above a metallic plate. A golf ball entering the golf cup displaces the carriage causing the metallic portion of the carriage to make contact with the metallic plate thus producing a metallic sound.

One disadvantage of the above-identified sound-producing golf cups is that the devices are designed to replace standard golf cups as opposed to providing an accessory therefor.

Another disadvantage of the Niina device is that an energy source is required to produce the sound.

Additionally, each of the above-identified sound-producing golf cups include numerous parts which may require maintenance or repair over time.

Based on the foregoing, it is the general object of the present invention to provide a golf cup bell that improves over, or overcomes the problems and drawbacks of the prior art.

SUMMARY OF THE INVENTION

According to the present invention, a golf cup bell is provided including a bell, and a bracket coupled to the bell. The bracket is for supporting the bell in a gold cup such that a golf ball, upon entering the golf cup, strikes the bell causing the bell to move relative to the bracket, thereby producing an audible ring. Thus, the bell provides an audible indicator for indicating the golf ball's entry into the golf cup. The present invention golf cup bell is designed to be removably mountable in a standard golf cup. The bell may define a central opening for receiving a flagstick therethrough.

In one embodiment of the invention, the golf cup bell includes a collar attached to a surface of the bell and a bracket defining an opening for receiving the collar therethrough. A plurality of retainers or tabs are provided for securing the bracket loosely about the collar so that the bell can resonate or move relative to the collar for producing an audible ring when the bell is struck by a golf ball. The bracket includes a lower portion for supporting the bell in the golf cup. The collar defines in part, a central opening in the bell for receiving a flagstick therethrough.

In accordance with the present invention, a golf cup, including a golf cup bell as described above, is also provided. The golf cup includes a cylindrical housing, a bell, and a bracket coupled to the bell for supporting the bell interior the housing, such that a golf ball upon entering the housing strikes the bell causing the bell to move relative to the bracket thereby producing an audible ring for indicating the golf ball's entry into the golf cup.

DETAILED DESCRIPTION OF THE INVENTION

Figure 1:
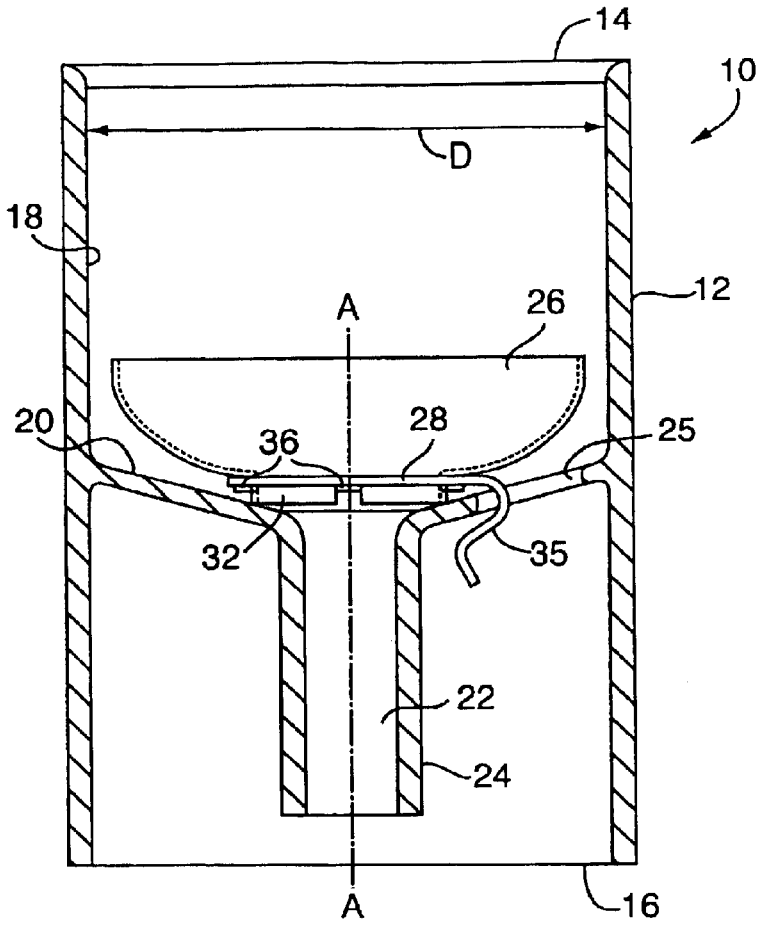
FIG. 1 is a partial cross-sectional elevational view of one embodiment of a golf cup according to the present invention.

Referring to FIG. 1, an embodiment of a golf cup according to the present invention is generally designated by the reference numeral 10. The golf cup 10 includes a cylindrical housing 12 having an axis A. The housing 12 has an open top 14 and an open bottom 16. An inner surface 18 of the housing 12 defines an inside diameter D of the golf cup 10. In a regulation golf cup, the inside diameter D is equal to 4.25 inches. A support member 20 is coupled to the inner surface 18 and defines a tubular portion 24 having an opening 22 concentric with the housing 12. The tubular portion 24 is for supporting a flagstick (not shown) in the opening 22 therein. The support member 20 further defines a plurality of openings 25 for providing drainage for the housing 12. In the golf cup shown in FIG. 1, the support member 20 is made integral with the housing 12.

Referring to FIGS. 1–6, a bell 26 is disposed interior the housing 12 and supported therein by a bracket 28. The bell 26 defines a central opening 30 for receiving a flagstick therethrough. A collar 32 is attached to an outer surface of the bell and in part defines the central opening 30. The bracket 28 defines an opening 34 for receiving the collar 32 and has a plurality of leg members 35 spaced about a perimeter thereof for mounting the bell 26 in the housing 12. A plurality of retainers or tabs 36 are formed in the collar 32 for securing the bracket 28 about the collar. The bracket 28 is designed to be loosely coupled to the bell 26, so that the bell can move relative to the bracket and produce the desired ring when the bell is struck by a golf ball. The leg members 35 define bends 38 and 40 along the length thereof for springedly engaging the drainage openings 25 in the golf cup 10 for securing the bell 26 therein. Alternatively, the bracket 28 could be made integral to the support member 20 or the housing 12.

Figure 2:
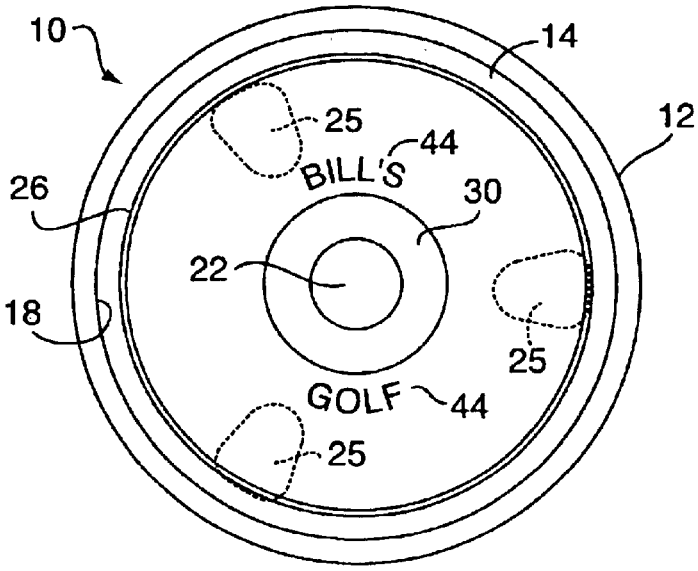
FIG. 2 is a top side view of the FIG. 1. embodiment of a golf cup according to the the present invention.
Figure 3:
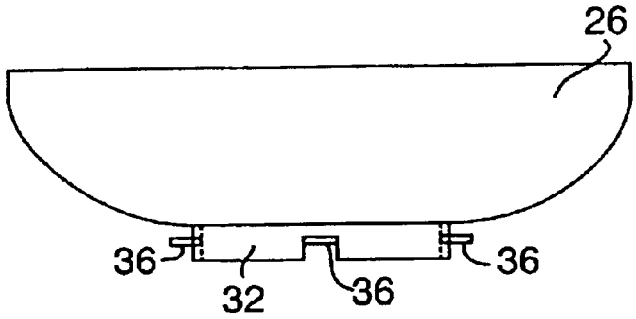
FIG. 3 is a side elevational view of a golf cup bell according to the present invention.
Figure 4:
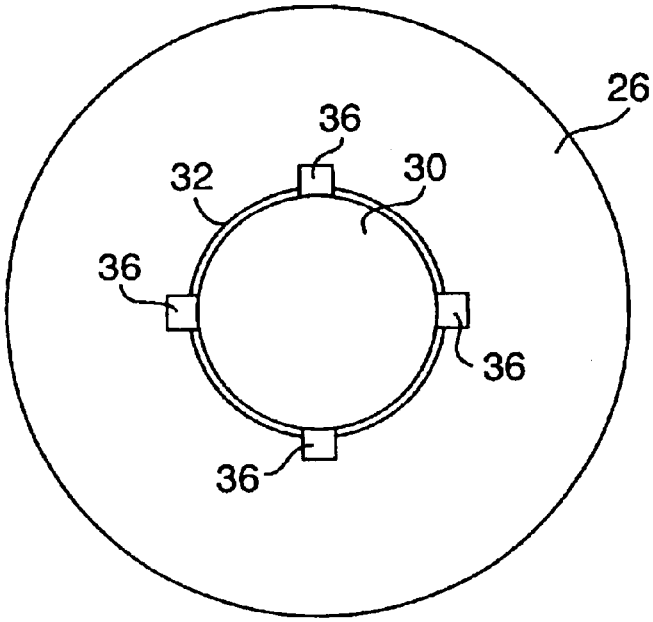
FIG. 4 is a bottom side view of the golf cup bell of FIG. 3.

FIG. 2, shows a top view of the bell 26 positioned in the housing 12 concentric therewith. The bell 26 is dimensioned such that an outer edge of the bell, 42 is spaced apart from the inner surface 18 of the housing 12 a maximum distance that is less than the diameter of a standard golf ball such that a golf ball cannot enter the golf cup 10 without striking the bell. Accordingly, the bell 26 can be a variety of sizes and shapes depending on the desired ring or sound to be produced. Additionally, the bell 26 may include advertising indicia 44 on a surface thereof such that the indicia is viewable from above the golf cup 10 when the bell is mounted therein.

Figure 5:
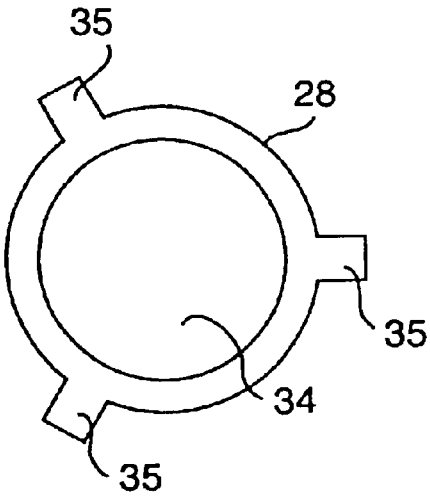
FIG. 5 is a top side view of a bracket for supporting the bell of FIG. 3.
Figure 6:
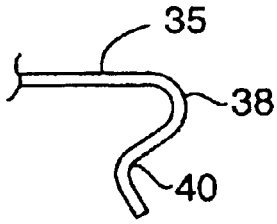
FIG. 6 is a partial side elevational view of the bracket of FIG. 5.

Referring now to FIGS. 3–6, the preferred embodiment of the present invention golf cup bell, includes the bell 26 and bracket 28 coupled thereto designed to be mountable in a standard golf cup. As shown in FIGS. 5 and 6, the bracket 28 includes leg members 35 having bends 38 and 40 in the length thereof and spaced apart one from the other so that the leg members cooperate to form a claw-like arrangement that is springedly engageable in a plurality of drainage openings in a standard golf cup for mounting the bell 26 therein.

Thus, the golf cup bell 26 can be secured in a standard golf cup by simply inserting the bell in the golf cup with the bracket 28 below the bell, aligning the leg members 35 with the drainage openings in the cup, and pushing the bell downward engaging the leg members with the drainage holes in the golf cup. Similarly, the bell can be removed from the golf cup by simply grasping the bell and pulling the bell upwards towards the top opening in the golf cup thereby disengaging the leg members 35 from the drainage openings in the golf cup and removing the bell therefrom.

The foregoing description of embodiments of the invention has been presented for the purposes of illustration and description, it is not intended to be exhaustive or to limit the invention to the form disclosed. Obvious modifications and variations are possible in light of the above disclosure. The embodiments described were chosen to best illustrate the principals of the invention and practical applications thereof to enable one of ordinary skill in the art to utilize the invention in various embodiments and with various modifications as suited to the particular use contemplated. It is intended that the scope of the invention be defined by the claims appended hereto.

What is claimed is:

1. A golf cup bell comprising:

a bell having a collar attached to a surface thereof;

a bracket defining an opening for receiving said collar, said bracket having a lower portion for supporting said bell in a golf cup;

at least one retainer for securing said bracket about said collar; and wherein a golf ball upon entering a golf cup having said golf cup bell mounted therein, strikes the bell causing the bell to move relative to said bracket producing an audible ring for indicating a golf ball's entry into a golf cup.

2. The golf cup bell as defined in claim 1 wherein said bell defines a central opening for receiving a flagstick therethrough.

3. The golf cup bell as defined in claim 1 wherein said collar partially defines a central opening in said bell for receiving a flagstick therethrough.

4. The golf cup bell as defined in claim 1 wherein said lower portion of said bracket further comprises a plurality of leg members.

5. The golf cup bell as defined in claim 4 wherein said leg members are configured to engage at least one drainage opening provided in a standard golf cup for securing said bracket therein.

6. The golf cup bell as defined in claim 4 wherein each of said plurality of leg members further comprise at least one bend in a length thereof and are spaced apart one from the other so that said leg members cooperate to form a claw-like arrangement springedly engageable in a plurality of drainage openings provided in a standard golf cup for mounting said bell therein.

7. The golf cup bell as defined in claim 1 wherein said bell further comprises advertising indicia on a surface thereof such that said indicia is viewable from above a golf cup when said bell is mounted therein.

8. The golf cup bell as defined in claim 1 wherein said bell is dimensioned such that a golf ball entering a golf cup having the bell mounted therein, strikes the bell.

9. The golf cup bell as defined in claim 1 wherein the bell is shaped to produce a desired tone.

10. A golf cup having a bell for producing an audible ring for indicating a golf ball's entry into the golf cup, said golf cup comprising:

a cylindrical housing;

a bell disposed in said housing and defining a central opening for receiving a flagstick therethrough, said bell having a collar attached to a surface thereof;

a bracket defining an opening for receiving said collar, said bracket having a lower portion for supporting said bell in said housing;

at least one retainer for securing said bracket about said collar; and wherein a golf ball upon entering said golf cup strikes the bell causing the bell to move relative to said bracket producing an audible ring for indicating a golf ball's entry into said golf cup.

11. The golf cup as defined in claim 10 further comprising a support member attached in said housing and defining an opening for receiving a flagstick.

12. The golf cup as defined in claim 10 wherein said collar partially defines said central opening in said bell.

13. The golf cup as defined in claim 10 wherein said at least one retainer includes a plurality of tabs formed in said collar.

14. The golf cup golf cup bell as defined in claim 10 wherein said bell further comprises advertising indicia on a surface thereof such that said indicia is viewable from above the golf cup.

15. The golf cup as defined in claim 10 wherein said bell is dimensioned such that a golf ball entering the golf cup strikes the bell.

16. The golf cup as defined in claim 10 wherein the bell is shaped to produce a desired tone.

17. The golf cup as defined in claim 11 wherein said lower portion of said bracket further comprises a plurality of leg members.

18. The golf cup as defined in claim 17 wherein said plurality of leg members are removably attached to said support member for mounting said bell in said housing.

19. The golf cup as defined in claim 11 wherein said lower portion of said bracket is integral to said support member.

* * * * *

UNITED STATES PATENT AND TRADEMARK OFFICE

CERTIFICATE OF CORRECTION

PATENT NO. : 6,726,575 B1
DATED : April 27, 2004
INVENTOR(S) : Thorp et al.

It is certified that error appears in the above-identified patent and that said Letters Patent is hereby corrected as shown below:

Column 4,
Line 49, please delete "golf cup bell".

Signed and Sealed this

Sixth Day of July, 2004

JON W. DUDAS
*Acting Director of the United States Patent and Trademark Office*